United States Patent [19]

Lindley

[11] 4,435,861

[45] Mar. 13, 1984

[54] LEDGE BED

[76] Inventor: William L. Lindley, P.O. Box 1292, Conroe, Tex. 77301

[21] Appl. No.: 352,348

[22] Filed: Feb. 25, 1982

[51] Int. Cl.[3] ..... A61G 7/00

[52] U.S. Cl. ..... 5/65; 5/63; 5/90

[58] Field of Search ..... 5/60, 63–69, 5/90

[56] References Cited

U.S. PATENT DOCUMENTS

| | | | |
|---|---|---|---|
| 247,921 | 10/1881 | Johnson | 5/65 |
| 638,755 | 12/1899 | Piper et al. | 5/63 |
| 726,472 | 4/1903 | Smith | 5/65 |
| 859,911 | 7/1907 | Bowling | 5/60 |
| 933,323 | 9/1909 | Mitchell . | |
| 1,815,742 | 11/1929 | Schiffhouer . | |
| 2,285,474 | 6/1942 | Urie | 5/69 |
| 2,373,017 | 4/1945 | Deckert | 5/90 |
| 2,445,158 | 4/1946 | Sparhawk | 5/60 |
| 2,827,641 | 3/1958 | Reichert et al. | 5/63 |
| 3,246,540 | 4/1966 | Pickles et al. | 5/66 |
| 3,312,985 | 4/1967 | Callaghan | 5/66 |
| 4,136,409 | 1/1979 | Ishida | 5/91 |
| 4,139,917 | 2/1979 | Fenwick | 5/66 |
| 4,183,109 | 1/1980 | Howell | 5/60 |

*Primary Examiner*—Alexander Grosz
*Assistant Examiner*—Michael F. Trettel
*Attorney, Agent, or Firm*—Pravel, Gambrell, Hewitt, Kirk & Kimball

[57] ABSTRACT

A ledge bed for use in hospitals, nursing homes and the like where it is desirable to position the ledge bed in a configuration suitable to place a bedpan or bathtub beneath a patient in bed without an attendant having to physically lift or move the patient. The ledge bed further includes inclination means for inclining head and foot mattress support sections as well as elevational means for elevating the ledge bed on telescopically connected support legs.

10 Claims, 3 Drawing Figures

10
12
12
14
14
16
17
17
18
18
20
22
22
22a
22b
22
24
24
26
26
46
48
48b
50
50a
52a
52a
52b
52b
54
54
56
56
57
57
59a
59a
59b
59b
D
E
F
P
L
L
L
L
L-1
L-2
L-3
L-4

LEDGE BED

FIELD OF THE INVENTION

The ledge bed of the present invention is intended for use in hospitals, nursing homes and the like where it is desirable to position a bedpan or bathtub beneath a patient lying on a bed without a hospital attendant having to physically lift the patient. The ledge bed of the present invention utilizes a single mattress placed upon a mattress support which comprises an upper torso or head mattress support section and a lower torso or foot mattress support section both pivotally and adjustably connected to a rigid main frame of the ledge bed. Ground engaging legs are telescopically connected to the rigid main frame. The ledge bed of the present invention further includes a stiff leg assembly pivotally connected to the upper mattress support. When the stiff leg assembly is positioned perpendicular to the ground surface and the rigid main frame is lowered over the telescopically connected legs a ledge is formed whereby a bedpan or bathtub can easily be placed beneath a patient.

BACKGROUND OF THE INVENTION

Generally, hospital beds provide for inclination of both the head and foot sections of the bed. As far as is known by the applicant, such inclination is obtained by inclining the head or foot mattress support sections which are pivotally connected to the bed's main frame. Inclination of either the head or foot section provides no configuration of the bed mattress whereby a hospital attendant may position a bedpan or bathtub beneath the patient without physically lifting or moving the patient.

Generally, prior art beds, such as shown in U.S. Pat. Nos. 933,323; 1,815,742; 2,445,158; 4,136,409; 4,139,917; and 4,183,109 have all provided means for variably adjusting mattress support sections of a hospital bed. However, only U.S. Pat. Nos. 933,323 and 4,139,917 were capable of also being positioned such that a bedpan could be placed beneath a patient without having to physically lift or move the patient. Specifically, U.S. Pat. No. 933,323 obtained such result by lowering a middle mattress support section while retaining the head and foot mattress support sections in a fixed vertical position. Moreover, U.S. Pat. No. 933,323 required the use of three separate bed mattresses, while U.S. Pat. No. 4,139,917 obtained such a configuration by the combined utilization of separate mattresses with an indented middle mattress and the lowering of the foot mattress support section and elevating the middle mattress support section.

SUMMARY OF THE INVENTION

A ledge bed for use in hospitals to position a bathtub or bedpan beneath a patient without a hospital attendant having to physically lift or move the patient on the ledge bed. The ledge bed includes a rigid main frame with legs telescopically connected to the main frame whereby the main frame may be raised or lowered. A lower mattress support section is adjustably connected to the main frame and an upper mattress support section is pivotally connected to the main frame by a swing arm. A stiff leg assembly is pivotally connected to the upper mattress support section. When the stiff leg assembly is vertically positioned to engage the floor surface and the main frame is lowered, the upper mattress support section is displaced vertically from the lower mattress support section to form a ledge. Inclination adjustment is possible for both the upper and lower mattress support sections in any position within the full vertical travel of the main frame.

The ledge bed of the present invention is designed to be compatible with and incorporate the operating features of beds presently in general use in hospitals or nursing homes. As such, existing hospital beds can easily be modified to accept the ledge bed concept of the present invention, as well as, provide for simple initial manufacture of ledge beds. The ledge bed obviates the need for the multiple hospital attendants, as is often the case, to assist in routine patient care practices, as well as, lessens the cooperative efforts required of the patient.

PREFERRED EMBODIMENT

Figure 1:
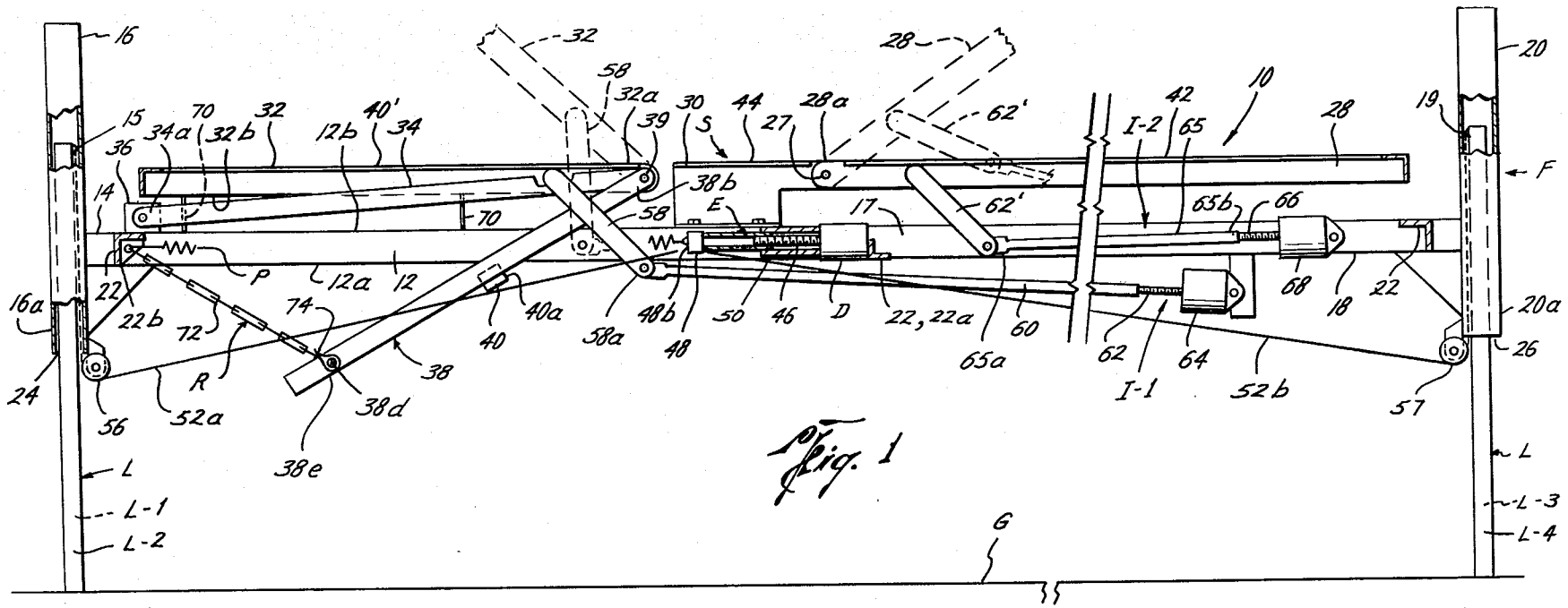
FIG. 1 is a side view, with certain parts in section, of the ledge bed in the up or normal use position with the head and foot mattress support sections shown inclined in phantom.

The ledge bed of the present invention is generally shown in the drawings as 10. The ledge bed 10 comprises a rigid main frame F, support legs L telescopically connected to the rigid main frame F to engage a ground surface G, a mattress support S pivotally connected to the main frame F, a mattress (not shown) mounted on the mattress support S and elevation means E with the main frame F for elevating the main frame F on telescopically connected support legs L.

Figure 3:
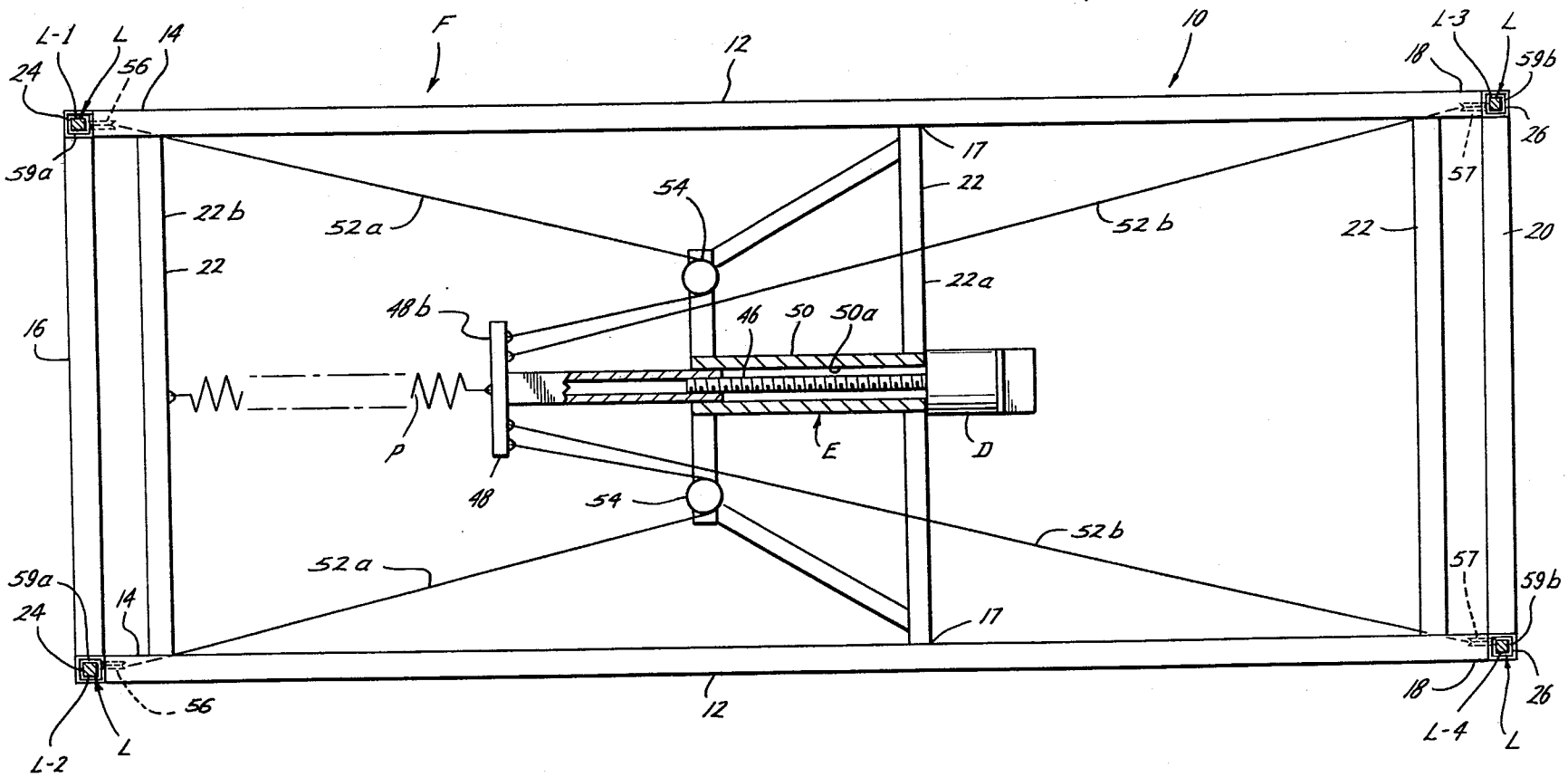
FIG. 3 is a plan view of the ledge bed depicting an elevation means for elevating the main frame.

Looking first at FIG. 1, rigid main frame F of the ledge bed 10 includes parallel side rails 12 having upper ends 14 rigidly connected to a headboard 16 and lower ends 18 rigidly connected to a footboard 20. Rigid main frame F further includes transverse crossbars 22 rigidly connected to side rails 12 at the upper and lower ends 14, 18 of side rails 12 and medially at 17 on side rails 12 as also shown in FIG. 3.

The headboard 16 is provided with telescopic connections 24 to telescopically accept support legs L-1 and L-2. The footboard 20 is provided with telescopic connections 26 to telescopically accept legs L-3 and L-4.

The mattress support S of the ledge bed 10 includes a rectangular lower torso or foot mattress support 28 which is pivotally connected at its upper end **28*a* to rectangular pivotal support plates 30 with pivot pins 27. Pivotal support plates 30 are connected to side rails 12 of main frame F a predetermined distance from footboard 20. The mattress support S further includes a rectangular upper torso or head mattress support 32 which is pivotally connected at its lower end 32*a* to swing arms 34 with pivot pins 39. The upper end 34*a* of swing arms 34 are pivotally connected to bracket plates 36 a predetermined distance from the pivot pin 39. Bracket plates 36 are rigidly connected to side rails 12 a predetermined distance from pivotal support plates 30. The swing arm 34 is provided with an indentation 34*b* on its upper surface 34*c*. Spacer supports 70 are rigidly connected to the underside 32***b* of upper mattress support 32.

Mattress support S also includes a stiff leg assembly 38 pivotally connected to head support section 32 and swing arm 34 by the common pivot pin 39. The stiff leg assembly 38 includes two parallel legs 38*a* with pivotal openings 38*b* at their upper ends 38*c* to accept pivot pin 39 and a transverse stiffner bar 38*d* rigidly attached to the lower ends 38*e* of parallel legs 38*a*. Downward travel stops 40 are connected to the parallel legs 38*a* a predetermined distance from pivot pin 39. When stiff leg assembly 38 is rotated and aligned perpendicularly to the ground surface G with the main frame F at the upper extent of its vertical travel, as shown in FIG. 1, the parallel legs 38*a* of stiff leg assembly 38 will just engage the ground surface G. To compensate for irregularities in the flatness of ground surface G and manufacturing tolerances of the ledge bed 10, the parallel legs 38*a* may be shorter than shown in the drawings by a predetermined distance so that the parallel legs 38*a* do not initially engage the ground surface G. When the stiff leg assembly 38 is lowered to the vertical position, but upon lowering the main frame F the parallel legs 38*a* will engage the ground surface G and thereafter will be in the position illustrated in FIG. 2.

A rectangular unitary mattress (not shown) is preferably mounted on the mattress support S which includes horizontal surface 40' of head support section 32, horizontal surface 42 of foot support section 28, as well as horizontal surface 44 of the pivot plates 30.

As best seen in FIG. 3, an elevation means E for elevating the main frame F includes a rotational drive means D, preferably an electric motor, which is mounted on crossbar 22*a* of the main frame F. The rotational drive means D is rotatably connected to a lead screw 46. Lead screw 46 coaxially and threadedly engages rectangular T-head assembly 48. Rectangular retainer sleeve 50 is rigidly connected to the main frame F and has an axial opening 50*a* whereby the T-head assembly is slideably and axially accepted. Since retainer sleeve 50 and T-head assembly 48 have congruent rectangular, slideably engageable cross-sections, rotation of lead screw 46 urges T-head assembly 48 to slideably advance or withdraw within retainier sleeve 50 rather than rotate.

Figure 2:
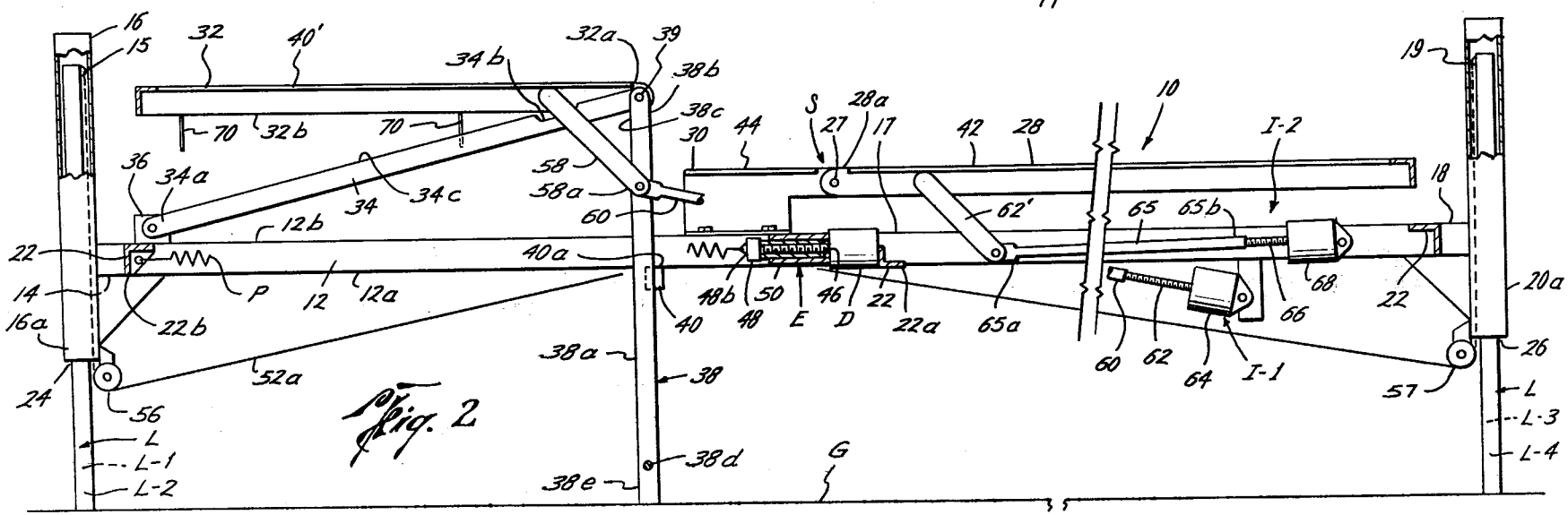
FIG. 2 is a side view, with certain parts in section, of the ledge bed in the down position for use with a bedpan or the like on the lowered portion.

The elevation means E further includes guy wires 52*a* and 52*b* securely connected to T-head assembly 48. Guy wires 52*a* rotatably engage redirection sheaves 54 which are rotatably connected to the main frame F and thence, rotatably engage lifting sheaves 56. As best seen in FIGS. 1, 2, lifting sheaves 56 are rotatably attached to lower ends 16*a* of headboard 16 of the main frame F. The guy wires 52*a* then pass through an annulus 59*a* defined by the telescopic engagement of support legs L-1 and L-2 and headboard telescopic connections 24. Further, guy wires 52*a* are then securely connected to upper ends 15 of support legs L-1 and L-2. Whereas guy wires 52*b* pass directly to and rotatably engage lifting sheaves 57 which are rotatably mounted at the lower end 20*a* of footboard 20 of the main frame F. The guy wires 52*b* then pass through an annulus 59*b* defined by the telescopic engagement of support legs L-3 and L-4 and footboard telescopic connection 26. Guy wires 52*b* are then securely connected to an upper end 19 of support legs L-3 and L-4. Further, a tension means P for tensioning T-head assembly 48 is securely connected to the main frame F on crossbar 22*b* and to a forward face 48*b* of T-head assembly 48. Tensioning means P is preferably a spring of predetermined resilience and contractive loading.

Ledge bed 10 of the present invention also includes inclination means I-1 and I-2 pivotally connected to the main frame F and rigidly connected to upper support section 32 and lower support section 28 for inclining the upper support section 32 and the lower support section 28, respectively. The inclination means I-1 includes a connecting arm 58 securely connected to upper support section 32 by welding or other suitable means a predetermined distance from pivot pin 39 whereby an acute angle is formed between head support section 32 and connecting arm 58. The lower end 58*a* of connecting arm 58 is pivotally connected to a thrust bar 60. A threaded drive screw 62 threadedly engages the thrust bar 60. Threaded drive screw 62 is rotatably connected to rotation means 64 which is pivotally connected to the main frame F. The thrust bar 60 either advances or withdraws when rotation means 64 is rotated causing upper support section 32 to pivot about pivot pin 39 to an inclined position as shown in phantom in FIG. 1. Similarly, inclination means I-2 includes a connecting arm 63 securely connected to lower support section 28 by welding or the like a predetermined distance from upper end 28*a* of lower support section 28 and forming an acute angle with lower support section 28. A thrust bar 65 is pivotally connected at its upper end 65*a* to connecting arm 62' and threadedly engages a threaded drive screw 66 at its lower end 65*b*. Threaded drive screw 66 is rotatably connected to a rotation drive means 68 pivotally connected with the main frame F. Rotation of the drive screw 66 causes the thrust bar 65 either to advance or withdraw whereby the lower support section 28 pivots to an inclined position as shown in phantom in FIG. 1. Rotation drive means 64 and 68 are preferably electric motors.

OPERATION

When it is desired to reposition ledge bed 10 from the configuration as shown in FIG. 1, the up or normal use position, to the configuration of FIG. 2, the down or bedpan use position, such that a bedpan or a bathtub can be placed beneath a patient, the hospital attendant rotates stiff leg assembly 38 such that it is perpendicular to the ground surface G as shown in FIG. 2 and thereafter, activates the elevation means E for lowering the main frame F. As the main frame F descends, the stiff leg assembly 38 will engage the ground surface G. As the main frame F continues to descend, the pivot pins 39 are maintained in a fixed vertical position whereby swing arms 34 which are pivotally connected to both head section 32 and the main frame F will rotate about both pivot connections to maintain the head section 32 at a predetermined vertical height above ground surface G. Downward travel of main frame F is limited by a travel stop 40 connected to parallel legs 38*a* whereby when the under surface 12*a* of side rails 12 come in contact with an upper surface 40*a* of travel stops 40 continued downward motion of main frame F is prohibited.

When it is desired to return the ledge bed 10 to a configuration in which the mattress support S is coplanar as shown in FIG. 1, the hospital attendant activates the elevation means E such that the main frame F ascends. As the main frame F rises with the stiff leg assembly 38 still engaging ground surface G, head section 32 is maintained in a fixed vertical position whereby swing arms 34, which are pivotally attached to both the main frame F and the head support section 32 pivot to accomodate the vertical rise of main frame F until spacer supports 70 attached to the under sides 32*b* of upper support section 32 make contact with an upper surface 12*b* of side rails 12. Spacer supports 70 and stiff leg assembly 38 are both of predetermined lengths whereby the spacer supports 70 just make contact with the side rails 12 as stiff leg assembly 38 just disengages the ground surface G. Further, spacer supports 70 are sized to position upper support section 32 in coplanar relation with lower support section 28 as best seen in FIG. 1.

Elevation of main frame F is initiated by activating rotation drive unit D. Rotation of rotation drive unit D in a direction whereby rotatably connected leadscrew 46 threadedly engages T-head assembly 48 and threadedly urges T-head assembly 48 to advance toward headboard 16 sliding through sleeve opening 50*a*. Guy wires 52*a* and 52*b* will thence exert a lifting force on lifting sheaves 56 and 57 rotatably attached to headboard and footboard sections 16 and 20. Likewise, rotation of the rotation drive unit D in the opposite direction whereby the rotatably connected leadscrew 46 threadedly engages T-head assembly 48 and threadedly retracts T-head assembly 48 towards the footboard 20 sliding through sleeve opening 50*a*. Retraction of T-head assembly 48 pays out guy wires 52*a* and 52*b* whereby the main frame F of the ledge bed 10 is lowered.

Inclination of the upper support section 32 and lower support section 28 of the ledge bed 10 will be understood by those skilled in the art to operate through the same cooperative effort. The operation of the upper support section 32 is now described. Activation of inclination rotation means 64 whereby drive screw 62 is rotated to threadedly engage thrust bar 60 and threadedly advance thrust bar 60 towards headboard 16. Advancing the thrust bar 60 urges pivotally connected connecting arm 58 upwardly whereby the upper support section 32 pivots upwardly about pivot pin 39, as shown in phantom in FIG. 1. Reversing the direction of rotation of inclination rotation drive means 64 reverses the above described operation whereby the upper support section 32 will pivot downwardly about pivot pin 39.

The operation of the lower support section 28 is now described. Activation of inclination rotation means 68 whereby drive screw 66 is rotated to threadedly engage thrust bar 65 and threadedly advance thrust bar 65 towards head section 16. Advancing thrust bar 65 urges pivotally connected connecting arm 62' upwardly whereby the lower support section 28 pivots upwardly about pivot pin 27, as shown in phantom in FIG. 1. Reversing the direction of rotation of inclination rotation drive means 68 reverses the above described operation whereby the lower support section 28 will pivot downwardly about pivot pin 27. It will be further understood and appreciated by those skilled in the art that combinations of inclination of either or both the head and foot sections, as well as elevation of main frame are permitted.

A retaining means R is attached to the main frame F for retaining the stiff leg assembly 38 in a stored position as shown in FIG. 1. Retaining means R is preferably a tether 72 having matcing VELCRO pads 74 at the lower end of the tether 72 whereby the tether 72 wraps around transverse stiffer 38*d* of stiff leg assembly 38 and matching VELCRO pads 74 are engaged to retain the stiff leg assembly 38 in the stored position. Moreover when the stiff leg assembly 38 is rotated to its stored position as shown in FIG. 1, elevation of the main frame does not disturb the coplanar mattress support surface S.

The foregoing disclosure and description of the invention are illustrative and explanatory thereof, and various changes in the size, shape and materials as well as in the details of the illustrated construction may be made without departing from the spirit of the invention and all such changes are contemplated as falling within the scope of the appended claims.

I claim:

1. A ledge bed for positioning a bedpan or bathtub beneath a patient on the ledge bed without having to physically lift or move the patient, comprising:

a main frame;

floor engaging support legs telescopically connected to said main frame;

a foot mattress support adjustably connected to said main frame;

an head mattress support pivotally connected to said main frame;

elevation means with said main frame for raising and lowering said main frame on said telescopically connected support legs; and, a stiff leg assembly pivotally connected to said head mattress support whereby when said stiff leg assembly is vertically positioned and said main frame is lowered, said stiff leg assembly will engage the floor surface whereupon said head mattress support will form a ledge vertically displaced above said foot mattress support.

2. The ledge bed of claim 1, further including:

inclination means with said main frame for inclining either said head mattress support or said foot mattress support.

3. The ledge bed of claim 1, further including:

inclination means with said main frame for inclining said head mattress support.

4. The ledge bed of claim 1, further including:

inclination means with said main frame for inclining said foot mattress support.

5. The ledge bed of claim 1, wherein the pivotally connected stiff leg assembly further includes:

a downward travel limit stop connected to said stiff leg assembly a predetermined distance from the stiff leg assembly pivotal connection whereby the downward movement of said main frame is limited.

6. The ledge bed of claim 1, wherein the pivotally connected head mattress support further includes:

a swing arm pivotally connected to said head mattress support with a pivot pin and pivotally connected to said main bed frame a predetermined distance from said head mattress support for maintaining said head mattress support horizontal when said main bed frame is lowered relative thereto.

7. The ledge bed of claim 1, wherein the head mattress support further includes:

a plurality of spacer elements connected to said head mattress support whereby said head mattress support can be maintained coplanar to said foot mattress support section.

8. The ledge bed of claim 1, further including:

retaining means for retaining said stiff leg assembly in a stored position.

9. The ledge bed of claim 1, wherein the elevation means includes:

guy wires securely connected to said telescopically connected support legs; and, lifting sheaves rotatably connected to said main frame and engaging said guy wires.

10. The elevation means of claim 9 further including:

a T-head assembly slideably connected to said main frame having said guy wires securely attached thereto;

a retainer sleeve securely attached to said main frame having an axial opening to receive said T-head assembly;

a lead screw threadedly engaging said T-head assembly; and, a rotational drive unit rotatably connected to said lead screw whereby rotation of said rotational drive unit advances and withdraws said T-head assembly to elevate said main frame.

* * * * *